US006824359B2

(12) United States Patent
Chlus et al.

(10) Patent No.: US 6,824,359 B2
(45) Date of Patent: Nov. 30, 2004

(54) TURBINE BLADE

(75) Inventors: Wieslaw A. Chlus, Wethersfield, CT (US); Stanley J. Funk, New Britain, CT (US)

(73) Assignee: United Technologies Corporation, Hartford, CT (US)

( * ) Notice: Subject to any disclaimer, the term of this patent is extended or adjusted under 35 U.S.C. 154(b) by 13 days.

(21) Appl. No.: 10/355,664

(22) Filed: Jan. 31, 2003

(65) Prior Publication Data

US 2004/0151586 A1 Aug. 5, 2004

(51) Int. Cl.[7] ..... F01D 5/18
(52) U.S. Cl. ..... 416/92; 416/97 R
(58) Field of Search ..... 416/97 R, 97 A, 416/96 R, 96 A, 90 R, 90 A, 92; 415/115, 116

(56) References Cited

U.S. PATENT DOCUMENTS 3,533,712 A 10/1970 Kercher
3,885,886 A 5/1975 Richter
3,934,322 A * 1/1976 Hauser et al. ..... 29/889.721
3,982,851 A 9/1976 Andersen et al.
4,010,531 A 3/1977 Andersen et al.
4,073,599 A 2/1978 Allen et al.
4,257,737 A 3/1981 Andress et al.
4,424,001 A * 1/1984 North et al. ..... 416/92
4,606,701 A 8/1986 McClay et al.
5,203,873 A * 4/1993 Corsmeier et al. ..... 416/96 A
5,246,341 A * 9/1993 Hall et al. ..... 416/97 R
5,261,789 A * 11/1993 Butts et al. ..... 416/96 R
5,464,479 A * 11/1995 Kenton et al. ..... 134/1
5,564,902 A * 10/1996 Tomita ..... 416/97 R
6,019,579 A * 2/2000 Fukuno et al. ..... 416/97 R
6,164,914 A * 12/2000 Correia et al. ..... 416/97 R
6,231,307 B1 * 5/2001 Correia ..... 416/97 R
6,652,235 B1 11/2003 Keith et al.

* cited by examiner

*Primary Examiner*—Edward K. Look
*Assistant Examiner*—James A. McAleenan
(74) *Attorney, Agent, or Firm*—Bachman & LaPointe, P.C.

(57) ABSTRACT

A turbine blade has a platform and an airfoil extending from a root at the platform to a tip. The airfoil has an internal cooling passageway network including at least one trailing edge cavity. A group of trailing edge holes extends from the trailing edge to the trailing edge cavity and a group of tip holes extends from the tip to the trailing edge cavity.

23 Claims, 3 Drawing Sheets

TURBINE BLADE

BACKGROUND OF THE INVENTION (1) Field of the Invention

This invention relates to turbomachinery, and more particularly to cooled turbine blades.

(2) Description of the Related Art

Heat management is an important consideration in the engineering and manufacture of turbine blades. Blades are commonly formed with a cooling passageway network. A typical network receives cooling air through the blade platform. The cooling air is passed through convoluted paths through the airfoil, with at least a portion exiting the blade through apertures in the airfoil. These apertures may include holes (e.g., "film holes" distributed along the pressure and suction side surfaces of the airfoil and holes at junctions of those surfaces at leading and trailing edges. Additional apertures may be located at the blade tip. In common manufacturing techniques, a principal portion of the blade is formed by a casting and machining process. During the casting process a sacrificial core is utilized to form at least main portions of the cooling passageway network. Proper support of the core at the blade tip is associated with portions of the core protruding through tip portions of the casting and leaving associated holes when the core is removed. Accordingly, it is known to form the casting with a tip pocket into which a plate may be inserted to at least partially obstruct the holes left by the core. This permits a tailoring of the volume and distribution of flow through the tip to achieve desired performance. Examples of such constructions are seen in U.S. Pat. Nos. 3,533,712, 3,885,886, 3,982,851, 4,010,531, 4,073,599 and 5,564,902. In a number of such blades, the plate is subflush within the casting tip pocket to leave a blade tip pocket or plenum.

BRIEF SUMMARY OF THE INVENTION

One aspect of the invention involves a blade having a platform and an airfoil with a root at the platform and a tip. The airfoil has leading and trailing edges and an internal cooling passageway network including at least one trailing edge cavity. Trailing edge holes extend from the trailing edge to the trailing edge cavity. Tip holes extend from the tip to the trailing edge cavity.

In various implementations, the tip holes and a distal group of the trailing edge holes may be outwardly diverging from the trailing edge cavity. The tip holes may be of circular cross section and may have a diameter between 0.3 and 2.0 mm. Each of the tip holes may have a circular cylindrical surface of a length at least five times longer than a diameter. There may be between two and six such tip holes. Each of the tip holes may extend through a casting of the blade. The blade may have a body and a tip insert and may have a tip plenum in communication with the cooling passageway network. The plenum may be bounded by a wall portion of the casting along pressure and suction sides of the airfoil and by an outboard surface of the tip insert subflush to a rim of the wall portion. The wall portion may be uninterrupted along a trailing portion of the plenum spanning the pressure and suction sides. The tip may have a relieved area along the pressure side. The relieved area may extend partially across openings of the tip holes.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
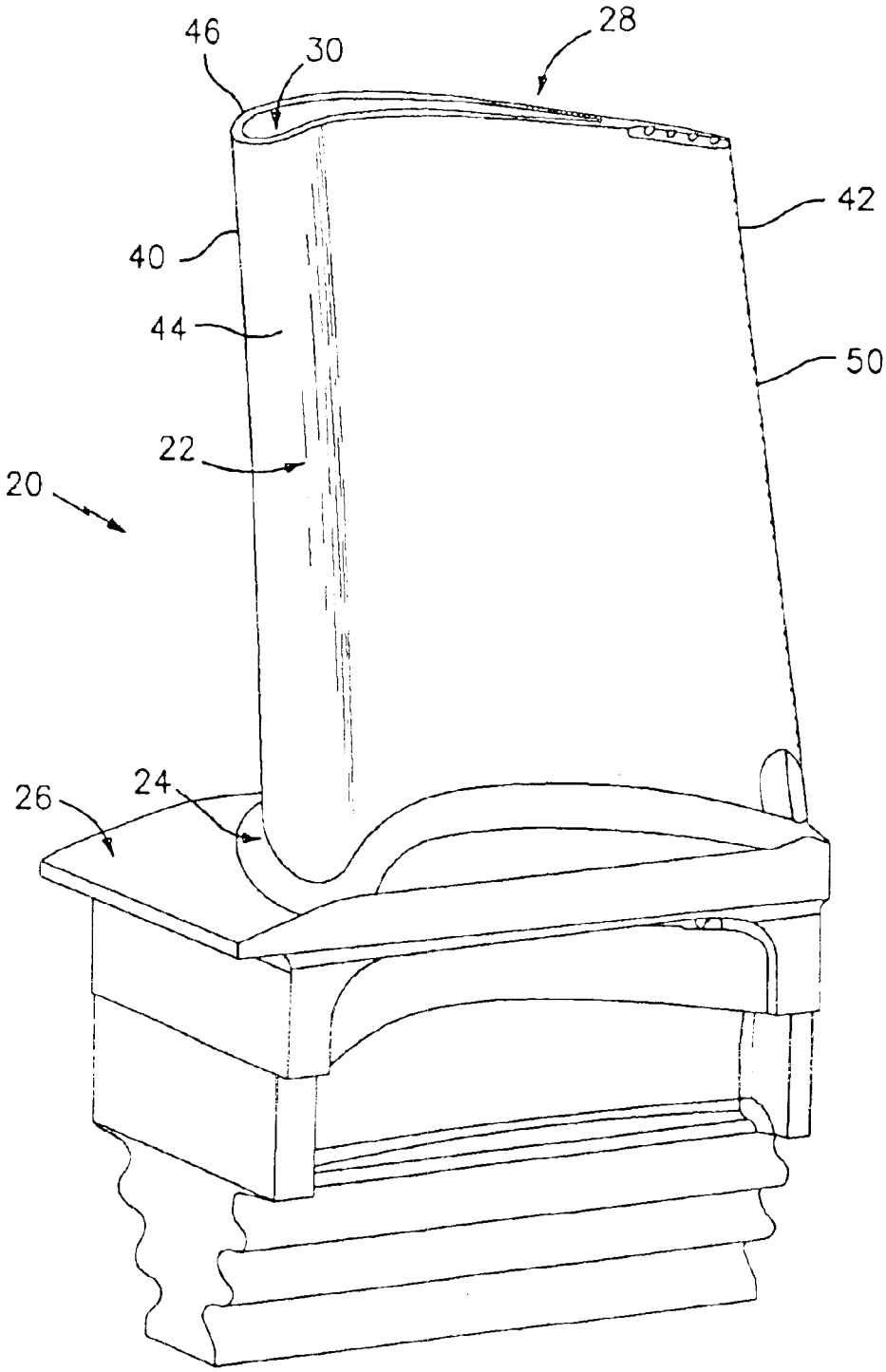
FIG. 1 is a view of a turbine blade according to principles of the invention.

FIG. 1 shows a turbine blade 20 having an airfoil 22 extending along a length from a proximal root 24 at an inboard platform 26 to a distal end tip 28. A number of such blades may be assembly side-by-side with their respective inboard platforms forming a ring bounding an inboard portion of a flow path. In an exemplary embodiment, a principal portion of the blade is unitarily formed of a metal alloy (e.g., as a casting). The casting is formed with a tip compartment in which a separate cover plate may be secured subflush to leave a tip plenum 30.

The airfoil extends from a leading edge 40 to a trailing edge 42. The leading and trailing edges separate pressure and suction sides or surfaces 44 and 46. For cooling the blade, the blade is provided with a cooling passageway network coupled to ports (not shown) in the platform. The exemplary passageway network includes a series of cavities extending generally lengthwise along the airfoil. A foremost cavity is identified as a leading edge cavity extending generally parallel to the leading edge. An aftmost cavity 48 (FIG. 2) is identified as a trailing edge cavity extending generally parallel to the trailing edge. These cavities may be joined at one or both ends and/or locations along their lengths. The network may further include holes extending to the pressure and suction surfaces 44 and 46 for further cooling and insulating the surfaces from high external temperatures. Among these holes may be an array of trailing edge holes 50 extending between the trailing edge cavity and a location proximate the trailing edge.

Figure 2:
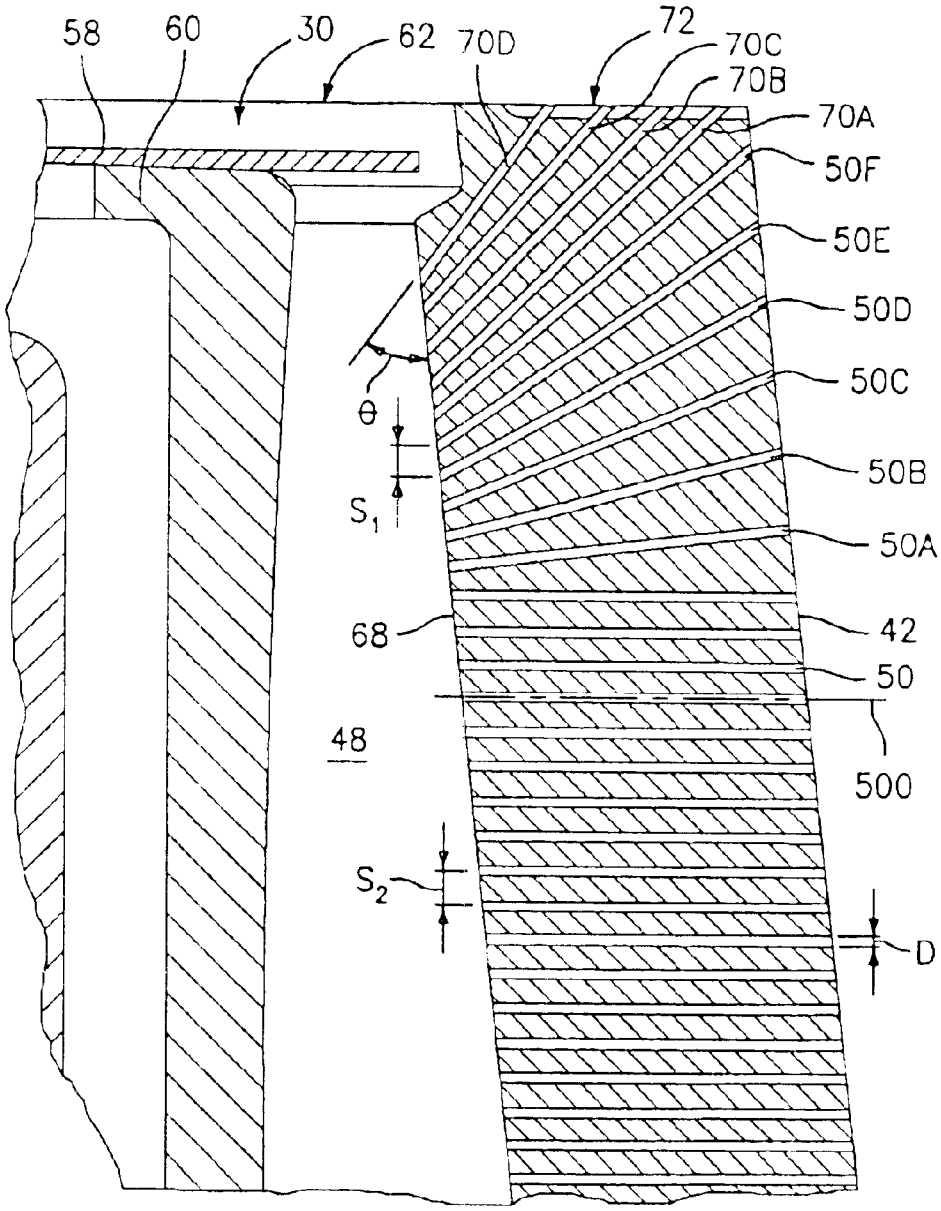
FIG. 2 is a partial sectional view of a trailing tip portion of the blade of FIG. 1.
Figure 3:
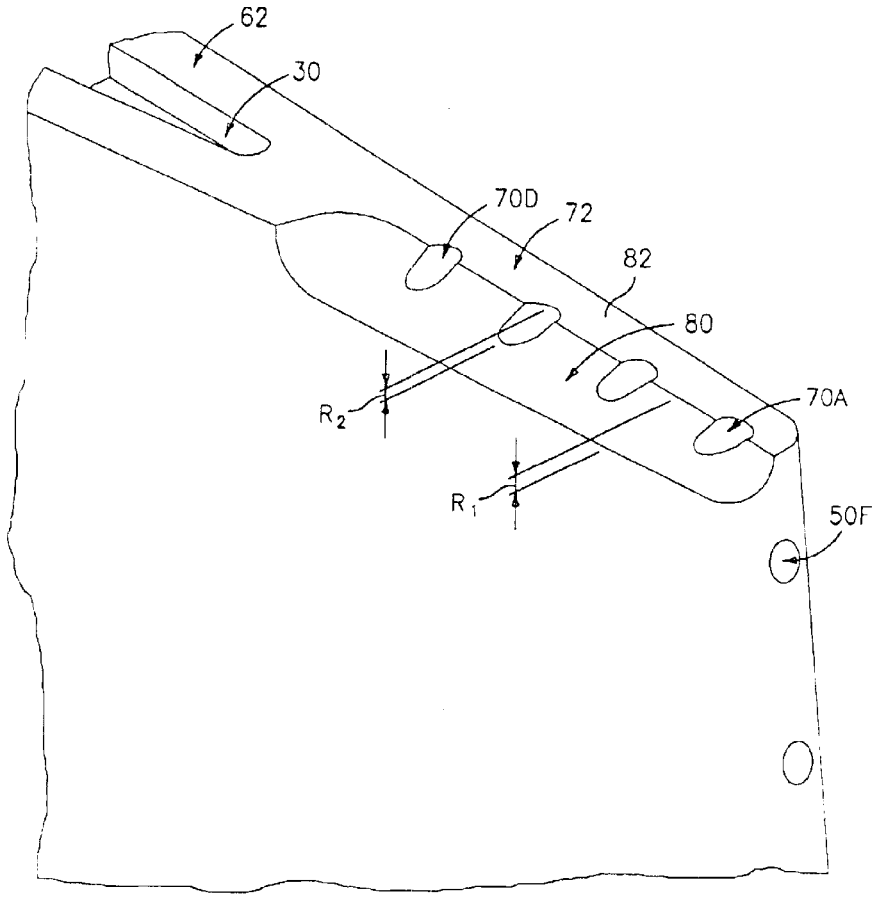
FIG. 3 is a partial view of a trailing tip portion of a pressure side of the blade of FIG. 1.

In an exemplary embodiment, the principal portion of the blade is formed by casting and machining. The casting occurs using a sacrificial core to form the passageway network. An exemplary casting process forms the resulting casting with the aforementioned casting tip compartment into which the cover plate 58 is secured (FIG. 2). The compartment has a web 60 having an outboard surface forming a base of the tip compartment. The outboard surface is below a rim 62 of a wall structure having portions on pressure and suction sides of the resulting airfoil. The web 60 is formed with a series of apertures. These apertures may be formed by portions of the sacrificial core mounted to an outboard mold for support. The apertures are in communication with the passageway network. The apertures may represent an undesired pathway for loss of cooling air from the blade. Accordingly it may be desired to fully or partially block some or all of the apertures with the cover plate 58. The cover plate may be installed by positioning it in place in the casting compartment and welding it to the casting. In operation, the rim (subject to recessing described below) is substantially in close proximity to the interior of the adjacent engine shroud (e.g., with a gap of about 10 mm).

FIG. 2 shows the exemplary trailing edge holes 50 as circular cylindrical holes having axes 500 and extending from the trailing edge 42 to the trailing extremity 68 of the trailing cavity 48. A group of the holes 50 are substantially parallel to each other and may be at a relatively even spacing. A second group (a distal group 50A, 50B, 50C, 50D, 50E, and 50F) are non-parallel, fanning outward from the trailing cavity 48. In the illustrated embodiment, the holes 50A–50F are a portion of a continuous fanning terminal group of holes, including tip holes 70A, 70B, 70C, and 70D, having inlet ends (inlets) along the trailing extremity 68 of the trailing cavity 48 and having outlet ends (outlets) along the blade tip. The exemplary holes are of circular section of diameter D. The inlet ends of the exemplary holes 50A–50F and 70A–70D are at a substantially even spacing (pitch) $S_1$ along the cavity trailing extremity 68. This pitch may advantageously be slightly smaller than a typical pitch between the remaining holes 50 (e.g., a pitch $S_2$ of an adjacent group of the holes 50). The holes progressively fan out so that an angle θ between their axes and the inboard direction along the trailing extremity 68 progressively decreases from a value of slightly over 90° for the last non-fanning hole 50 to a value of close to 45° for the final hole 70D. The fanning and decreased pitch serve to provide enhanced cooling of the trailing tip portion of the blade relative to a mere continuation of the parallel array of holes 50. In the exemplary embodiment, the outlet ends of the holes 70A–70D lie along a trailing portion 72 of the rim 62 aft of the compartment 30. In the exemplary embodiment, the rim trailing portion 72 has a pressure side chamfer 80 which extends at least partially across the outlets of the holes 70A–70D. This chamfer serves to recess a portion of the tip below an intact suction side portion 82 of the trailing portion 72. In turbine operation, the intact portion 82 lies in close facing parallel proximity to the adjacent surface of the shroud (not shown) with the recess provided by the chamfer 80 directing flow from the outlets of the holes 70A–70D rearwardly along the surface of the chamfer to cool the pressure side of the tip adjacent the trailing edge.

In an exemplary method of manufacture, the holes 50, 50A–50F, and 70A–70D may be machined via drilling (e.g., laser drilling). This is done after the blade is cast or otherwise fabricated and optionally after an initial post-casting machining. At least the fanning holes may be drilled by sequentially progressively reorienting a single-bit drill (or single-beam drill in the case of laser drilling). After the holes are drilled, the chamfer 80 may be ground into the rim as part of a final machining. The recess provided by the chamfer also serves to resist occlusion of the tip holes. In the absence of the recess, incidental contact between the rim portion 72 and the shroud could drive material into the tip holes, plugging them. By recessing at least pressure side portions of the hole outlets below the intact portion 82, such occlusion is resisted. The exemplary chamfer is concave, having a depth $R_1$ relative to the intact portion 82 at the pressure side and a depth $R_2$ at the pressure side intersection of the holes 70A–70D with the chamfer. In the exemplary embodiment, these depths increase slightly progressively from the trailing edge forward. The exemplary depths $R_1$ are in the vicinity of 0.5–3.0 times the hole diameter and the exemplary depths $R_2$ on the order of 0.25–2.0 times the hole diameter.

In exemplary embodiments, there may advantageously be 2–6 tip holes and 2–10 fanning trailing edge holes. There may potentially be more depending on factors including blade size. In more narrow embodiments, there may be 3–5 tip holes and 4–8 fanning trailing edge holes. Exemplary hole diameters are between 0.3 and 2.0 mm. Exemplary hole lengths are between 10 and 30 times the hole diameters (more narrowly between 15 and 25 times). In exemplary embodiments, the fanning of the holes changes the angle θ by a net amount of between 30° and 60° from that of the non-fanning holes.

One or more embodiments of the present invention have been described. Nevertheless, it will be understood that various modifications may be made without departing from the spirit and scope of the invention. For example, many details will be application-specific. To the extent that the principles are applied to existing applications or, more particularly, as modifications of existing blades, the features of those applications or existing blades may influence the implementation. Accordingly, other embodiments are within the scope of the following claims.

What is claimed is:

1. A blade comprising:
a platform; and
an airfoil having:
a root at the platform;
a tip;
leading and trailing edges; and
an internal cooling passageway network including:
at least one trailing edge cavity;
a plurality of trailing edge holes extending from the trailing edge to the trailing edge cavity; and
a plurality of tip holes extending from the tip to the trailing edge cavity and having a circular cylindrical surface of a length at least five times longer than a diameter.

2. The blade of claim 1 wherein there are between two and six such tip holes.

3. The blade of claim 1 wherein the tip holes and a distal group of said trailing edge holes are outwardly diverging from the trailing edge cavity.

4. The blade of claim 1 wherein for each of the tip holes said length is between ten and thirty said diameter.

5. The blade of claim 1 wherein for each of the tip holes said length is between fifteen and twenty-five times said diameter.

6. The blade of claim 1 wherein a fanning of a first group of said trailing edge holes and said tip holes changes a hole angle a net amount of between 30° and 60° from an angle of a second group of the trailing edge holes.

7. The blade of claim 1 wherein for each of the tip holes said diameter is between 0.3 and 2.0 mm.

8. A blade comprising:
a platform; and
an airfoil having:
a root at the platform;
a tip;
leading and trailing edges; and
an internal cooling passageway network including:
at least one trailing edge cavity;
a plurality of trailing edge holes extending from the trailing edge to the trailing edge cavity; and
a plurality of tip holes extending from the tip to the trailing edge cavity wherein:

the blade comprises a body and a tip insert and has a tip plenum in communication with the cooling passageway network and bounded by a wall portion of the casting along pressure and suction sides of the airfoil and an outboard surface of the tip insert subflush to a rim of the wall portion.

9. The blade of claim 8 wherein the wall portion is uninterrupted along a trailing portion of the plenum spanning the pressure and suction sides.

10. The blade of claim 8 wherein the tip holes and a distal group of said trailing edge holes are outwardly diverging from the trailing edge cavity.

11. The blade of claim 8 wherein at least some of the tip holes and at least some of the trailing edge holes form a fanning terminal group of holes.

12. A blade comprising:

a platform; and an airfoil having:

a root at the platform;

a tip having a relieved area;

leading and trailing edges; and an internal cooling passageway network including:

at least one trailing edge cavity;

a plurality of trailing edge holes extending from the trailing edge to the trailing edge cavity; and a plurality of tip holes extending from the tip to the trailing edge cavity, the relieved area extending only partially across openings of said tip holes.

13. The blade of claim 12 wherein the relieved area is along the pressure side.

14. The blade of claim 12 wherein the relieved area is concave.

15. A turbine blade comprising:

a platform; and an airfoil having:

a root at the platform;

a tip having a rim;

leading and trailing edges;

an internal cooling passageway network having a trailing cavity; and plurality of tip holes extending from the trailing cavity to the rim; and means for preventing contact-induced occlusion of said tip holes.

16. The blade of claim 15 wherein the plurality of tip holes are outwardly diverging from the trailing edge cavity to the trailing edge and tip.

17. A method for manufacturing a blade comprising:

casting a turbine element precursor comprising:

a platform; and an airfoil:

extending along a length from a proximal root at the platform to a distal end;

having leading and trailing edges separating pressure and suction sides; and having a cooling passageway network including at least one trailing edge cavity;

machining a first plurality of holes in the airfoil extending from the trailing edge to the trailing edge cavity;

machining a second plurality of holes in the airfoil extending from the tip to the trailing edge cavity; and forming a chamfer along a trailing pressure side portion of said tip, said chamfer extending Only partially through openings of said second plurality of holes.

18. The method of claim 17 wherein:

the first plurality of holes and the second plurality of holes are machined as a continuous fanning terminal group of holes.

19. The method of claim 17 wherein:

the chamfer is a concave chamfer.

20. The method of claim 17 wherein:

said machining of said second plurality of holes comprises sequentially progressively reorienting a drill so as to form said second plurality of holes diverging from the trailing edge cavity.

21. The method of claim 17 wherein the machining of the first plurality of holes and the machining of the second plurality of boles comprise laser drilling.

22. A method for manufacturing a blade comprising:

casting a turbine element precursor comprising:

a platform; and an airfoil:

extending along a length from a proximal root at the platform to a distal end;

having leading and trailing edges separating pressure and suction sides; and having a cooling passageway network including at least one trailing edge cavity;

machining a first plurality of holes in the airfoil extending from the trailing edge to the trailing edge cavity; and machining a second plurality of holes in the airfoil extending from the tip to the trailing edge cavity, the second plurality of holes fanning a continuous fanning terminal group of holes with at least some of the first plurality of holes.

23. The method of claim 22 wherein the machining of the first plurality of holes and the machining of the second plurality of holes comprise laser drilling.

* * * * *

UNITED STATES PATENT AND TRADEMARK OFFICE

CERTIFICATE OF CORRECTION

PATENT NO. : 6,824,359 B2
DATED : November 30, 2004
INVENTOR(S) : Wieslaw A.Chlus et al.

It is certified that error appears in the above-identified patent and that said Letters Patent is hereby corrected as shown below:

Column 4,
Line 36, after "thirty" -- times -- should be inserted.

Column 6,
Line 8, "Only"should read -- only --.
Line 24, "boles" should read -- holes --.
Line 39, "fanning" (first occurrence) should read -- forming --.

Signed and Sealed this

Fifth Day of April, 2005

JON W. DUDAS
*Director of the United States Patent and Trademark Office*